US011006212B2

(12) United States Patent
Smithers et al.

(10) Patent No.: US 11,006,212 B2
(45) **Date of Patent: *May 11, 2021**

(54) UPWARD FIRING LOUDSPEAKER HAVING ASYMMETRIC DISPERSION FOR REFLECTED SOUND RENDERING

(71) Applicant: Dolby Laboratories Licensing Corporation, San Francisco, CA (US)

(72) Inventors: Michael J. Smithers, Kareela (AU); Alan J. Seefeldt, Alameda, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/578,328

(22) Filed: Sep. 21, 2019

(65) Prior Publication Data

US 2020/0021909 A1 Jan. 16, 2020

Related U.S. Application Data

(63) Continuation of application No. 15/752,883, filed as application No. PCT/US2016/046635 on Aug. 11, 2016, now Pat. No. 10,425,723.

(Continued)

(51) Int. Cl.
*H04R 1/40* (2006.01)
*H04R 1/34* (2006.01)

(Continued)

(52) U.S. Cl.
CPC ..... *H04R 1/403* (2013.01); *H04R 1/025* (2013.01); *H04R 1/30* (2013.01); *H04R 1/345* (2013.01); *H04R 3/04* (2013.01); *H04R 1/26* (2013.01); *H04R 1/2865* (2013.01); *H04R 2205/024* (2013.01); *H04R 2400/11* (2013.01); *H04R 2420/01* (2013.01)

(58) Field of Classification Search
None
See application file for complete search history.

(56) References Cited

U.S. PATENT DOCUMENTS 4,344,504 A 8/1982 Howze
4,870,691 A 9/1989 Mindel (Continued)

FOREIGN PATENT DOCUMENTS

CN 104284281 1/2015
DE 9012169 10/1990

(Continued)

*Primary Examiner* — James K Mooney

(57) ABSTRACT

A speaker for transmitting reflected sound waves off an upper surface down to a listening environment, comprising: a cabinet containing a plurality of audio drivers, direct-firing drivers within the cabinet oriented to transmit sound along a horizontal axis substantially perpendicular to a front surface of the cabinet, and a pair of upward-firing slotted drivers placed proximate to ends of an top surface of the cabinet and oriented at an inclination angle relative to the horizontal axis. The slotted drivers are configured to create an overlapping reflected sound projection for high frequency sound when reflected down to a listening position located at a distance in front of the speaker pair. Such a speaker projects reflected sound that provides wider horizontal or side-to-side dispersion to better cover the listening area.

11 Claims, 12 Drawing Sheets

Related U.S. Application Data

(60) Provisional application No. 62/205,148, filed on Aug. 14, 2015, provisional application No. 62/323,001, filed on Apr. 15, 2016.

(51) Int. Cl.

| | |
|---|---|
| ***H04R 1/02*** | (2006.01) |
| ***H04R 1/30*** | (2006.01) |
| ***H04R 3/04*** | (2006.01) |
| *H04R 1/26* | (2006.01) |
| *H04R 1/28* | (2006.01) |

(56) References Cited

U.S. PATENT DOCUMENTS

| | | | |
|---|---|---|---|
| 5,901,235 | A | 5/1999 | Thigpen |
| 6,533,063 | B1 | 3/2003 | Keuchi |
| 8,224,001 | B1 | 7/2012 | Waller |
| 8,363,865 | B1 | 1/2013 | Bottum |
| 2003/0219139 | A1 | 11/2003 | Baird |
| 2004/0020711 | A1 | 2/2004 | China |
| 2004/0109575 | A1 | 6/2004 | Thigpen |
| 2004/0245043 | A1 | 12/2004 | Noselli |
| 2004/0247140 | A1 | 12/2004 | Norris |
| 2006/0169530 | A1 | 8/2006 | Noselli |
| 2006/0177075 | A1 | 8/2006 | Opie |
| 2007/0086615 | A1 | 4/2007 | Cheney |
| 2008/0019558 | A1 | 1/2008 | Simidian, II |
| 2009/0310808 | A1 | 12/2009 | Button |
| 2010/0119089 | A1 | 5/2010 | Tracy |
| 2011/0188661 | A1 | 8/2011 | Ehrig |
| 2011/0243362 | A1 | 10/2011 | Chick |
| 2012/0033841 | A1 | 2/2012 | Donarski |
| 2012/0121118 | A1 | 5/2012 | Fregoso |
| 2012/0213387 | A1 | 8/2012 | Blore |
| 2013/0228393 | A1 | 9/2013 | Sterling |
| 2013/0236031 | A1 | 9/2013 | Risberg |
| 2013/0243232 | A1 | 9/2013 | Dimitrov |
| 2013/0251177 | A1 | 9/2013 | Chabanne et al. |
| 2014/0126753 | A1 | 5/2014 | Takumai |
| 2015/0003662 | A1 | 1/2015 | Vernon |
| 2015/0049899 | A1 | 2/2015 | Mellow |
| 2015/0104054 | A1 | 4/2015 | Adams |
| 2015/0195643 | A1 | 7/2015 | Smithers |
| 2017/0127211 | A1 | 5/2017 | Crockett |
| 2017/0208392 | A1 | 7/2017 | Smithers |

FOREIGN PATENT DOCUMENTS

| | | |
|---|---|---|
| EP | 1330936 | 11/2009 |
| GB | 937872 | 9/1963 |
| GB | 2428531 | 1/2007 |
| WO | 2009126131 | 10/2009 |
| WO | 2014036085 | 3/2014 |
| WO | 2014107714 A1 | 7/2014 |

UPWARD FIRING LOUDSPEAKER HAVING ASYMMETRIC DISPERSION FOR REFLECTED SOUND RENDERING

CROSS-REFERENCE TO RELATED APPLICATIONS

This application is a Continuation Application of U.S. patent application Ser. No. 15/752,883, filed on Feb. 14, 2018, which claims priority to PCT Application No. PCT/US2016/046635 filed on Aug. 11, 2016, which in turn claims priority from U.S. Provisional Patent Application 62/205,148 filed on Aug. 14, 2015 and U.S. Provisional Patent Application 62/323,001 filed on Apr. 15, 2016, all of which are hereby incorporated by reference.

FIELD OF THE INVENTION

One or more implementations relate generally to audio speakers, and more upward firing speakers having asymmetric dispersion for producing reflected signals in spatial sound playback.

BACKGROUND

The advent of digital cinema has created new standards for cinema sound, such as the incorporation of multiple channels of audio to allow for greater creativity for content creators and a more enveloping and realistic auditory experience for audiences. Model-based audio descriptions have been developed to extend beyond traditional speaker feeds and channel-based audio as a means for distributing spatial audio content and rendering in different playback configurations. The playback of sound in true three-dimensional (3D) or virtual 3D environments has become an area of increased research and development. The spatial presentation of sound utilizes audio objects, which are audio signals with associated parametric source descriptions of apparent source position (e.g., 3D coordinates), apparent source width, and other parameters. Object-based audio may be used for many multimedia applications, such as digital movies, video games, simulators, and is of particular importance in a home environment where the number of speakers and their placement is generally limited or constrained by the confines of a relatively small listening environment.

Various technologies have been developed to more accurately capture and reproduce the creator's artistic intent for a sound track in both full cinema environments and smaller scale home environments. A next generation spatial audio (also referred to as "adaptive audio") format has been developed that comprises a mix of audio objects and traditional channel-based speaker feeds along with positional metadata for the audio objects. In a spatial audio decoder, the channels are sent directly to their associated speakers or down-mixed to an existing speaker set, and audio objects are rendered by the decoder in a flexible manner. The parametric source description associated with each object, such as a positional trajectory in 3D space, is taken as an input along with the number and position of speakers connected to the decoder. The renderer utilizes certain algorithms to distribute the audio associated with each object across the attached set of speakers. The authored spatial intent of each object is thus optimally presented over the specific speaker configuration that is present in the listening environment.

Current spatial audio systems have generally been developed for cinema use, and thus involve deployment in large rooms and the use of relatively expensive equipment, including arrays of multiple speakers distributed around a theatre. An increasing amount of advanced audio content, however, is being made available for playback in the home environment through streaming technology and advanced media technology, such as Blu-ray disks, and so on. In addition, emerging technologies such as 3D television and advanced computer games and simulators are encouraging the use of relatively sophisticated equipment, such as large-screen monitors, surround-sound receivers and speaker arrays in home and other listening environments. In spite of the availability of such content, equipment cost, installation complexity, and room size remain realistic constraints that prevent the full exploitation of spatial audio in most home environments. For example, advanced object-based audio systems typically employ overhead or height speakers to playback sound that is intended to originate above a listener's head. In many cases, and especially in the home environment, such height speakers may not be available. In this case, the height information is lost if such sound objects are played only through floor or wall-mounted speakers.

To overcome issues with height speakers along ceilings or upper walls, reflected sound speakers have been developed to allow floor or low mounted speakers to reflect audio content with height cues off of the ceiling or upper walls. Such as product and system is described in patent application No. 62/007,354 (D14054USP1), which is hereby incorporated by reference in its entirety. FIG. 1 illustrates the orientation of an upward firing speaker as so described. As shown in FIG. 1, a floor or bookshelf speaker 102 includes a driver or driver array oriented upwards to reflect sound off a point or area 104 on an upper surface, typically the ceiling, onto the listening position 106 so that sounds intended to originate from the height location still do so even if they are projected from a much lower location 102. This effectively replaces a height or ceiling loudspeaker with a more convenient floor standing unit.

As is known, a loudspeaker driver is a device that converts electrical energy into acoustic energy or sound waves. In its simplest form, a typical loudspeaker driver consists of a coil of wire bonded to a cone or diaphragm and suspended such that the coil is in a magnetic field and such that the coil and cone or diaphragm can move or vibrate perpendicular to the magnetic field. An electrical audio signal is applied to the coil and the suspended components vibrate proportionally and generate sound. With respect to speaker dispersion, a traditional loudspeaker driver, mounted in a cabinet has a dispersion or directivity character which is wide, often omnidirectional, at low frequencies and narrow, or more directional, at higher frequencies. FIG. 2 shows example a cross section view of a loudspeaker cone 204 in a sealed cabinet 206 and how the sound radiation pattern or dispersion becomes narrower at higher frequencies. As shown in FIG. 2, the sound dispersion pattern 201 at low frequencies is very wide, substantially 360 degrees for the example shown, while the sound dispersion pattern 203 for mid-frequencies is narrower (e.g., 120 degrees), while the sound dispersion pattern 205 for high frequencies is narrower still (e.g., 60 degrees). The amount of narrowness also depends on the size of the loudspeaker driver, with larger diameter drivers exhibiting narrower dispersion at lower frequencies than smaller diameter drivers.

When a typical circular cone loudspeaker driver is used in an upward firing loudspeaker, as in FIG. 1, lower frequency sounds radiate in all directions whilst higher frequency sounds radiate toward the ceiling and reflect off the ceiling to toward the listening position, in accordance with the frequency-dependent sound dispersion patterns shown in FIG. 2. FIG. 3A illustrates an example high frequency sound dispersion pattern 302 for a typical known upward firing loudspeaker firing reflected sound off of a ceiling. FIG. 3A shows the effect of the higher frequency dispersion pattern for a typical loudspeaker driver used to reflect sound of a ceiling. As shown in FIG. 3A, a fairly narrow angle of radiation 301 from the driver becomes a fairly wide area 303, once the sound has reflected from the ceiling and down onto listening position 307.

For typical stereo or surround sound audio content, speakers are often deployed in pairs. Thus, the speaker array in FIG. 3A may actually comprise two upward firing speakers placed on either side of the television or viewing screen. FIG. 3B shows a front view of the sound dispersion for the speaker setup of FIG. 3A. As shown in FIG. 3B, the two (left and right) upward firing loudspeakers create respective reflected sound dispersion patterns 304 and 306, which provide separate left and right ceiling sound images. FIG. 3C shows a top view of the sound dispersion patterns of FIG. 3B. It can be seen in FIGS. 3B and 3C that at high frequencies, neither speaker provides good sound coverage at the listening position. A person sitting in the center receives little energy from both speakers, and person sitting at either side of the listening position 307 received predominantly energy from the nearest upward firing loudspeaker. One way to provide more even high frequency coverage at the listening position 307 is to rotate the loudspeakers such that they face the listening position. This is shown in FIGS. 4A and 4B, where FIG. 4A illustrates a front view of example sound dispersion for the speakers of FIG. 3A rotated inwards and FIG. 4B illustrates a top view of the sound dispersion patterns 404 and 406 of FIG. 3B. As can be seen in FIGS. 4A and 4B, the overlapping region 403 of the high frequency sound is not large and is very dependent on loudspeaker aiming, as shown for the example rotation angle 402 for the loudspeakers, which helps overlap the two sound dispersion patterns 404 and 407 onto listening position 407.

What is needed therefore, is a speaker system for reflected sound that provides wider horizontal or side-to-side dispersion to better cover the listening area.

For purposes of the present description, the term loudspeaker means complete loudspeaker cabinet incorporating one or more loudspeaker drivers; a driver or loudspeaker driver means a transducer which converts electrical energy into sound or acoustic energy, and sound dispersion or dispersion means or describes the directional way sound from a source, in this case a loudspeaker, is dispersed or projected. Wide dispersion indicates that a source radiates sound widely and fairly consistently in many directions; the widest being omnidirectional where sound radiates in all directions. Narrow dispersion indicates that a source radiates sound more in one direction and over a limited angle. Dispersion can be different in different axes, for example vertical and horizontal, and can be different at difference frequencies.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions. Dolby and Atmos are registered trademarks of Dolby Laboratories Licensing Corporation.

BRIEF SUMMARY OF EMBODIMENTS

Embodiments are directed to a speaker for transmitting sound waves to be reflected off an upper surface of a listening environment, comprising: a cabinet containing a plurality of audio drivers; one or more direct-firing driver within the cabinet and oriented to transmit sound along a horizontal axis substantially perpendicular to a front surface of the cabinet; and a pair of upward-firing slotted drivers placed proximate to ends of an top surface of the cabinet and oriented at an inclination angle relative to the horizontal axis. The top surface of the cabinet may be built as an inclined surface, and wherein the inclination angle is between 18 degrees to 22 degrees. Each of the slotted drivers may comprises a cone or magnetic ribbon driver projecting through a slotted baffle, or they may each comprise a horn driver with an exit portion formed into a rectangular slot. The slot comprising the formed horn or slotted baffle comprises a narrow rectangle having a height dimension approximately 4 to 8 times a width dimension of the rectangle. The slot dimension is configured to produce at high frequencies, a relatively wide sound dispersion pattern perpendicular to the slot axis, and a relatively narrow sound dispersion pattern along the slot axis. The wide and narrow sound dispersion patterns for the pair of slotted drivers is configured to create an overlapping reflected sound projection for the high frequencies when reflected down to a listening position located at a distance in front of the speaker. A virtual height filter circuit may be used in conjunction with the speaker to apply a frequency response curve to a signal transmitted to the slotted drivers to create a target transfer curve. The virtual height filter compensates for height cues present in sound waves transmitted directly through the listening environment in favor of height cues present in the sound reflected off the upper surface of the listening environment.

The speaker may be implemented as a single unitary soundbar speaker or as a pair or array of independent speaker cabinets each having an upward firing slotted driver deployed in a pair or array of multiple speakers to create an overlapping sound dispersion pattern for high frequency reflected sounds.

INCORPORATION BY REFERENCE

Each publication, patent, and/or patent application mentioned in this specification is herein incorporated by reference in its entirety to the same extent as if each individual publication and/or patent application was specifically and individually indicated to be incorporated by reference.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Figure 1:
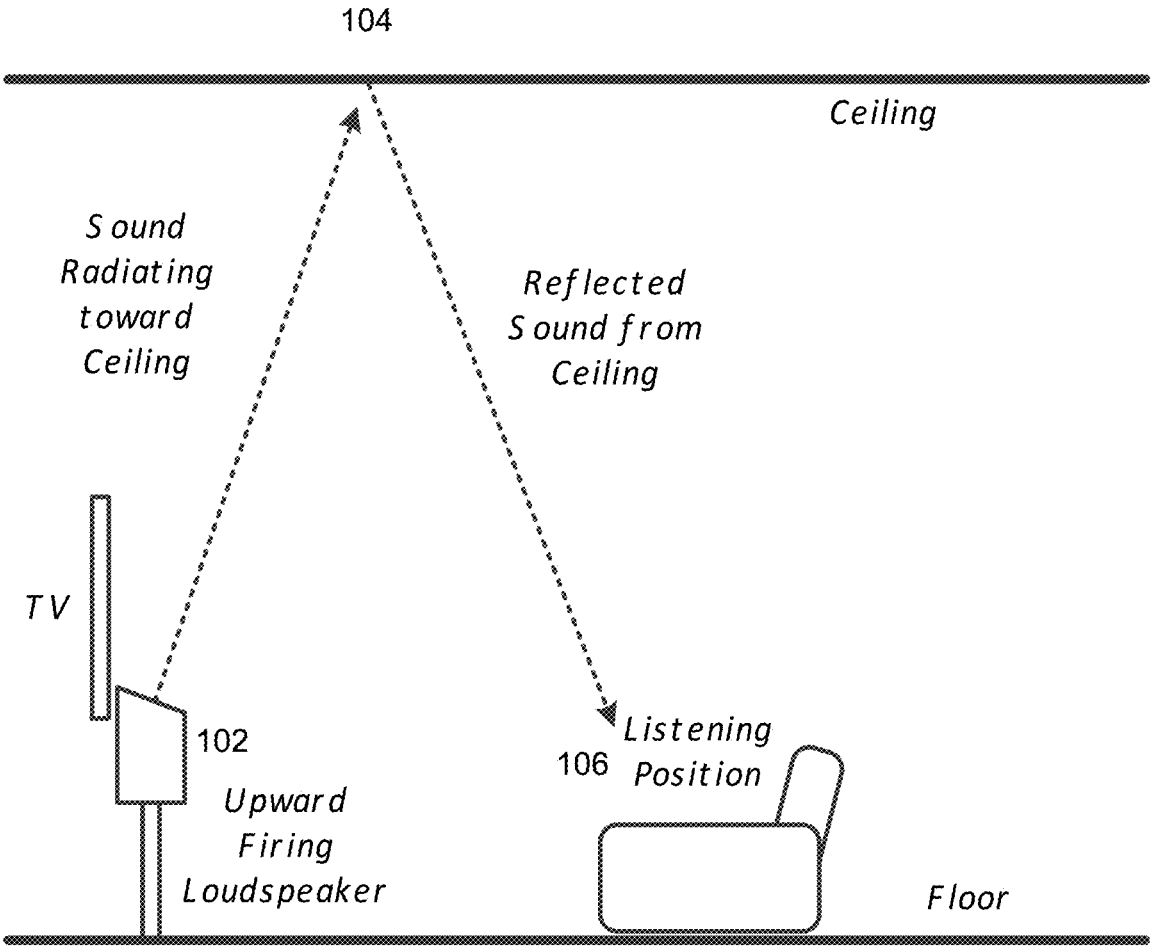
FIG. 1 (PRIOR ART)
FIG. 1 illustrates the use of an upward-firing driver using reflected sound to simulate an overhead speaker, as presently known.
Figure 2:
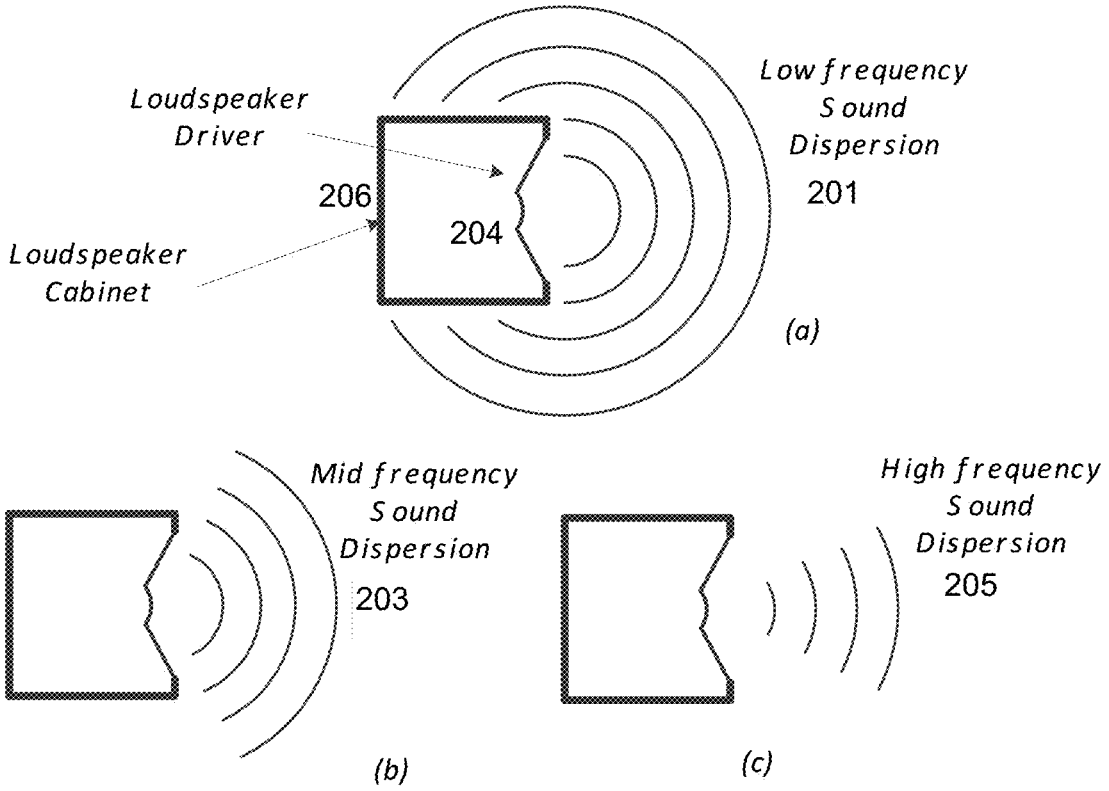
FIG. 2 (PRIOR ART)
FIG. 2 illustrates example sound dispersion patters for a typical loudspeaker for low, mid, and high frequencies.

Embodiments are described for loudspeakers and soundbars that incorporate slotted drivers to improve sound dispersion by preventing or reducing frequency effects when projecting sound reflected off of ceilings and upper wall surfaces. Aspects of the one or more embodiments described herein may be implemented in an audio or audio-visual (AV) system that processes source audio information in a mixing, rendering and playback system that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

In addition to definitions already given and for purposes of the present description, the following terms have the associated meanings: the term "channel" means an audio signal plus metadata in which the position is coded as a channel identifier, e.g., left-front or right-top surround; "channel-based audio" is audio formatted for playback through a pre-defined set of speaker zones with associated nominal locations, e.g., 5.1, 7.1, and so on; the term "object" or "object-based audio" means one or more audio channels with a parametric source description, such as apparent source position (e.g., 3D coordinates), apparent source width, etc.; and "spatial audio" or "adaptive audio" means channel-based and/or object-based audio signals plus metadata that renders the audio signals based on the playback environment using an audio stream plus metadata in which the position is coded as a 3D position in space; and "listening environment" means any open, partially enclosed, or fully enclosed area, such as a room that can be used for playback of audio content alone or with video or other content, and can be embodied in a home, cinema, theater, auditorium, studio, game console, and the like. Such an area may have one or more surfaces disposed therein, such as walls or baffles that can directly or diffusely reflect sound waves.

Embodiments are directed to a reflected sound rendering system that is configured to work with a sound format and processing system that may be referred to as a "spatial audio system" that is based on an audio format and rendering technology to allow enhanced audience immersion, greater artistic control, and system flexibility and scalability. An overall adaptive audio system generally comprises an audio encoding, distribution, and decoding system configured to generate one or more bitstreams containing both conventional channel-based audio elements and audio object coding elements. Such a combined approach provides greater coding efficiency and rendering flexibility compared to either channel-based or object-based approaches taken separately. An example of an adaptive audio system that may be used in conjunction with present embodiments is embodied in the commercially available Dolby Atmos system.

In general, audio objects can be considered as groups of sound elements that may be perceived to emanate from a particular physical location or locations in the listening environment. Such objects can be static (stationary) or dynamic (moving). Audio objects are controlled by metadata that defines the position of the sound at a given point in time, along with other functions. When objects are played back, they are rendered according to the positional metadata using the speakers that are present, rather than necessarily being output to a predefined physical channel. In an embodiment, the audio objects that have spatial aspects including height cues may be referred to as "diffused audio." Such diffused audio may include generalized height audio such as ambient overhead sound (e.g., wind, rustling leaves, etc.) or it may have specific or trajectory-based overhead sounds (e.g., birds, lightning, etc.).

Dolby Atmos is an example of a system that incorporates a height (up/down) dimension that may be implemented as a 9.1 surround system, or similar surround sound configuration (e.g., 11.1, 13.1, 19.4, etc.). A 9.1 surround system may comprise composed five speakers in the floor plane and four speakers in the height plane. In general, these speakers may be used to produce sound that is designed to emanate from any position more or less accurately within the listening environment. In a typical commercial or professional implementation speakers in the height plane are usually provided as ceiling mounted speakers or speakers mounted high on a wall above the audience, such as often seen in a cinema. These speakers provide height cues for signals that are intended to be heard above the listener by directly transmitting sound waves down to the audience from overhead locations.

Upward Firing Soundbar Speaker

As shown in FIG. 1, certain upward firing speakers have been developed to overcome situations in which ceiling mounted overhead speakers are not available or practical to install. In this case, the height dimension must be provided by floor or low wall mounted speakers. In an embodiment, the height dimension is provided by a speaker system having upward-firing drivers that simulate height speakers by reflecting sound off of the ceiling. In an adaptive audio system, certain virtualization techniques are implemented by the renderer to reproduce overhead audio content through these upward-firing drivers, and the drivers use the specific information regarding which audio objects should be rendered above the standard horizontal plane to direct the audio signals accordingly.

Figure 5:
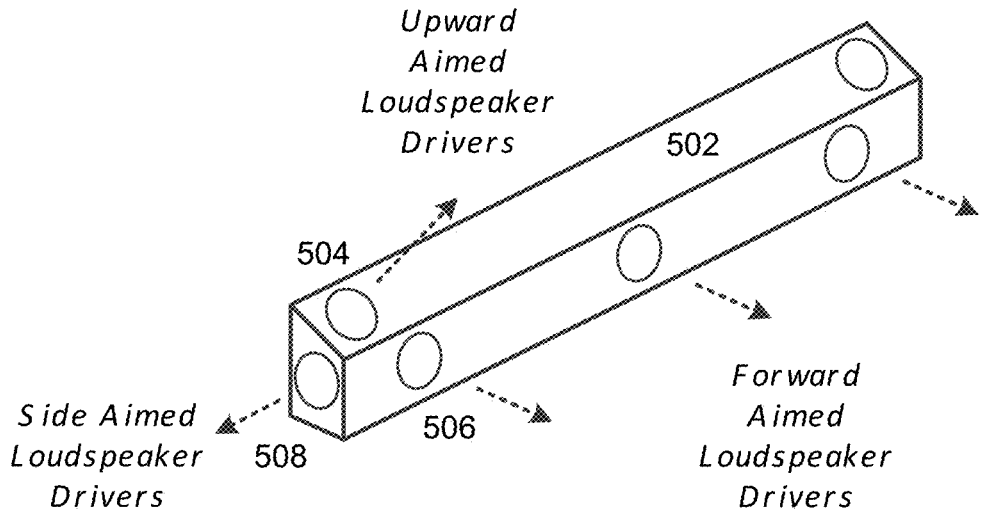
FIG. 5 illustrates a soundbar speaker incorporating certain features of a sound dispersion improvement under some embodiments.
Figure 6:
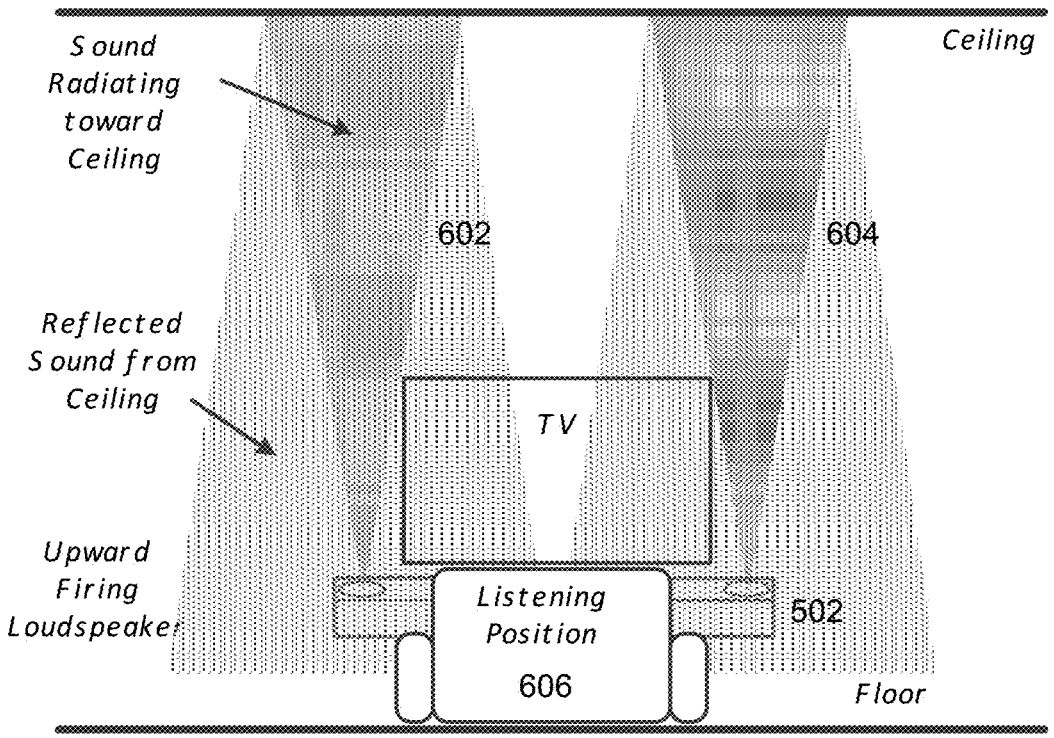
FIG. 6 illustrates the approximate high frequency sound dispersion for the upward firing drivers of the soundbar of FIG. 5 under an example embodiment.

Increasingly products are becoming available that integrate multiple loudspeaker drivers, aimed in different directions, and signal processing to present a surround sound experience at the listening position without the need for multiple, separate, loudspeakers around the room. These products are often called soundbars, which is a loudspeaker that features an elongated cabinet that is meant to match or approximate the width of a television screen and is often installed or placed below and/or in front of a television. FIG. 5 illustrates a soundbar speaker incorporating certain features of a sound dispersion improvement under some embodiments. Soundbar 502 shows an example that has a top baffle tilted at the desired aiming angle of the upward firing drivers. Alternatively the top could be flat and the drivers mounted in angled recesses. FIG. 5 illustrates an example soundbar incorporating forward, side and upward firing drivers. FIG. 6 illustrates a front view of high frequency sound dispersion for soundbar product loudspeaker drivers upward firing to reflect sound off a ceiling or upper wall surface. For the embodiment of FIG. 5, soundbar 502 includes a number of drivers including forward firing drivers 506, side firing drivers 508 and upward firing drivers 504. The angle of the upward firing drivers is set by the angle that the top surface of the speaker cabinet is formed, and can vary depending on design and manufacturing configurations. Other methods of setting the upward firing angle are also possible, such as swivel mounted drivers, variable angle cabinets, and so on.

FIG. 6 illustrates the approximate high frequency sound dispersion for the upward firing drivers of the soundbar of FIG. 5 under an example embodiment. As shown in FIG. 5, soundbar 502 is placed below and/or right in front of a television or display monitor and the two drivers of the soundbar provide left and right ceiling sound images 602 and 604. In a standard configuration, the reflected sound pattern indicates that at high frequencies, neither speaker provides particularly good sound coverage at the listening position 606.

Figure 4A:
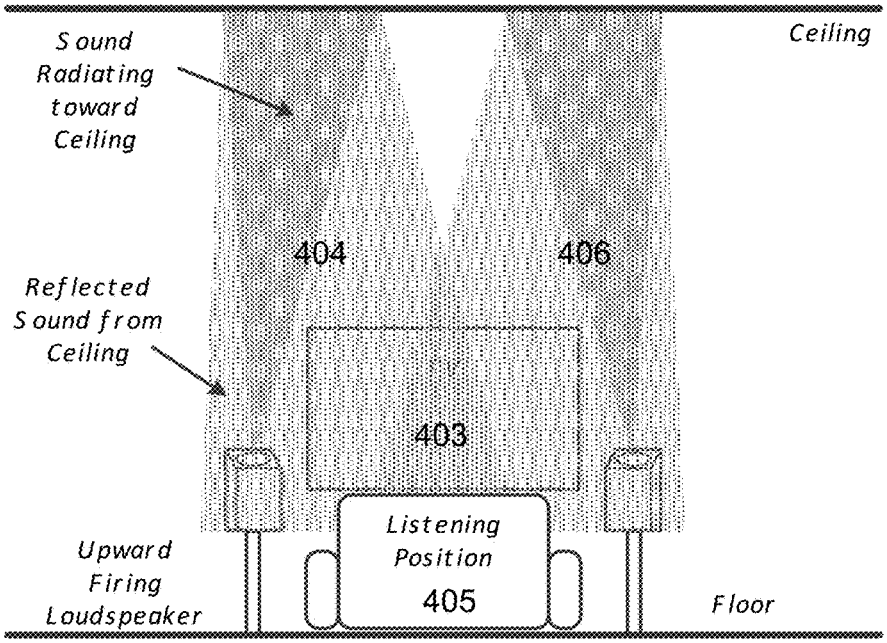
FIG. 4A (PRIOR ART)
FIG. 4A illustrates a front view of example sound dispersion for the speakers of FIG. 3A rotated inwards.

One way to remedy this effect is to move the drivers closer together, either in the existing soundbar cabinet or by making the soundbar shorter. This would provide some overlap in high frequency coverage at the listening position, but would also bring the two ceiling spatial image locations closer together, and lessen the perceived sense of width or spaciousness of the sound playback. The drivers could also be angled toward the listener, as for the separate loudspeakers shown in FIG. 4A and FIG. 4B, however the physical design and/or the small form factor of the soundbar often prevents more complicated mounting.

Another way to remedy the high-frequency sound coverage issue shown in FIG. 6 is to change the driver design or add different types of drivers to improve the dispersion pattern. In an embodiment, soundbar 502 is modified by adding a slot drivers to achieve improved sound dispersion for reflected audio signals. A typical cone-type loudspeaker driver has a dispersion pattern or radiation angle that is conical, i.e., it is the same for any axis perpendicular to the axis of aiming. This is indirectly shown in FIG. 3B and FIG. 3C in that the example radiation angle is the same for the side and front views. Slots or line exits provide a means of achieving asymmetric dispersion, i.e., dispersion that is wider on one axis and narrow on another. For purposes of description, the term "slotted driver" may refer to any type of loudspeaker that features a slot or narrow rectangular orifice through which the sound is projected. Such a driver may be implemented as a standard cone-type or ribbon-type driver covered with a baffle through which a slot is cut, or through a horn driver formed with a slotted horn, or any other driver or transducer formed into a slot or covered by a slotted baffle or cover. In general, the slot is generally a narrow rectangle with a proportion of a height dimension that is approximately 4 to 8 times the width dimension, though other dimensions are possible.

Figure 7:
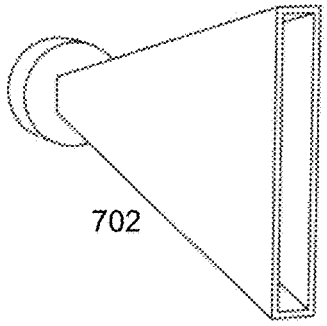
FIG. 7 shows an example compression driver with a horn that has a slot exit, and that may be used in a soundbar for reflected audio playback under some embodiments.
Figure 8:
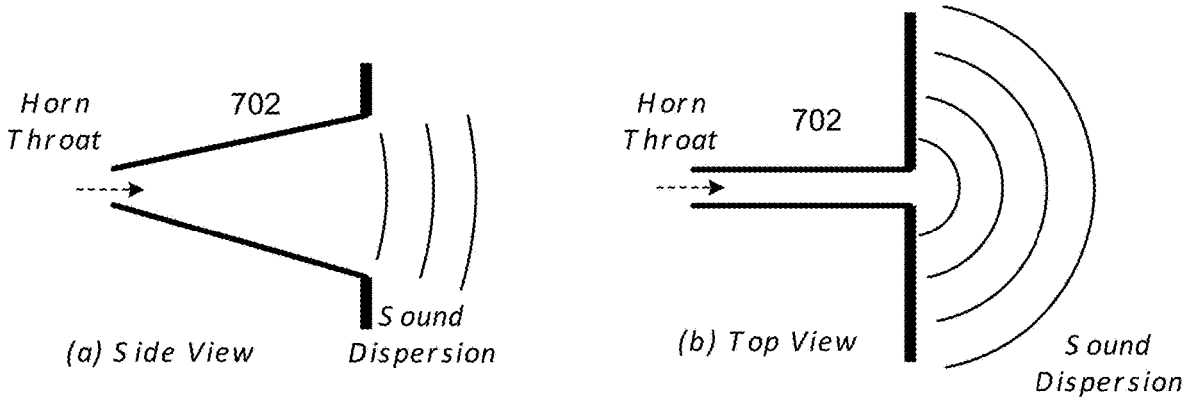
FIG. 8 illustrates a compression driver with a slot or line exit horn, and shows the approximate dispersion behavior of the slot exit under some embodiments.

FIG. 7 shows an example compression driver with a horn 702 that has a slot exit, and that may be used in a soundbar for reflected audio playback under some embodiments. FIG. 8 illustrates a compression driver with a slot or line exit horn, and shows the approximate dispersion behavior of the slot exit under some embodiments. FIG. 8 shows example sound dispersion patterns for a side view (a) and a top view (b) for slot speaker 702 when it is mounted in a baffle, which is a flat panel like the face of a loudspeaker cabinet. For the axis perpendicular to the slot length, shown in the top view (b) of FIG. 8, sound diffracts easily and the dispersion is wide. In the other axis as shown in side view (a) of FIG. 8, the dispersion is narrow. Driver 702 of FIG. 7 generally represents a driver that is substantially flat or planar in it sound pressure wave.

Figure 9:
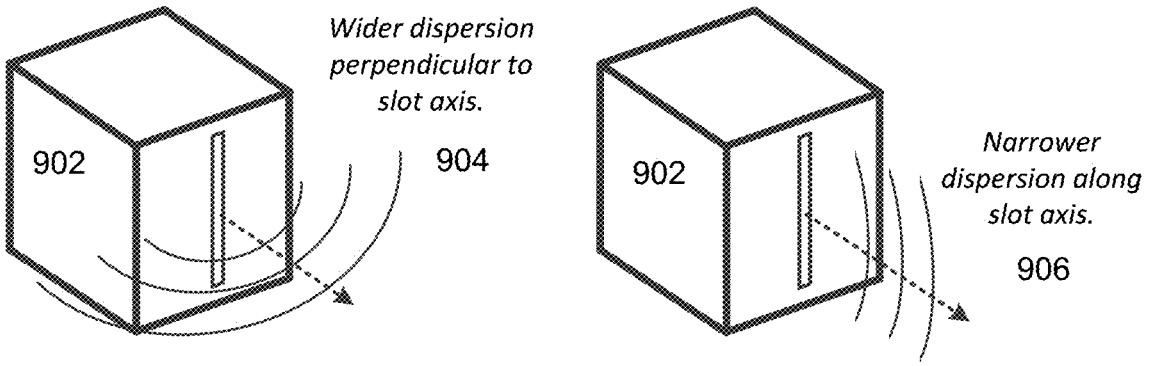
FIG. 9 illustrates sound dispersion of a slot or line exit horn driver as mounted in a loudspeaker cabinet in an example embodiment.

FIG. 9 illustrates sound dispersion of a slot or line exit horn driver as mounted in a loudspeaker cabinet 902 in an example embodiment. As shown in FIG. 9, the sound dispersion 904 along an axis perpendicular to the slot axis is relatively wide, and wider than the sound dispersion 906 along the slot axis.

The dimensions of the slot for speaker 702 as used in a soundbar or other cabinet for reflected sound playback can vary depending on system and listening environment constraints and configurations. In general, frequencies with wavelengths longer than approximately twice the slot width will diffract to give very wide horizontal dispersion. For example for a 15 mm slot width, frequencies below 11 kHz will diffract easily resulting in very wide horizontal dispersion. Above this frequency, the horizontal beam width will slowly narrow with increasing frequency. Some horizontal dispersion narrowing is acceptable at higher frequencies, provided the beam width it is still wide enough to radiate sound to the desired listening area. In an embodiment, a slot width of 15 mm is used, as it is generally appropriate for most playback situations and content, though other widths are also possible.

The height of the slot affects the vertical beamwidth and therefore the front-to-back width of the coverage at the listening position. Similar to the width relationship described above, frequencies with wavelengths longer than approximately twice the slot height diffract easily and the vertical beam width is very wide. For example, for a 150 mm length slot, frequencies below about 1 kHz diffract easily and the vertical beamwidth is very wide. Above this frequency, the beamwidth increasingly narrows. For a 150 mm length planar driver, the beam width narrows to about less than 10 degrees at 20 kHz. In an embodiment a slot height or planar driver height of approximately 100 mm results in a fairly narrow front-back coverage area that is still wide enough to cover the depth of a couch or sofa, though other heights are also possible.

To calculate appropriate slot dimensions (height and width), the following relationships can be used to determine the wavelength that is used to optimize the slot dimensions:

$$c=f*w$$

c=speed of sound (approx. 343 meters/second)

f=frequency in cycles per second or Hz w=wavelength in meters

Example: for 3000 Hz, one wavelength w=c/f=343/3000=0.1143 m=114.3 mm

Instead of using a horn with a slot exit, the cabinet in FIG. 9 could consist of a typical (cone-type) loudspeaker driver placed behind a slot exit, and where the slot length is approximately the same as the diameter of the driver. The dispersion patter is similar to the horn case, though not as consistent with frequency due to internal reflections between the loudspeaker driver and the front panel containing the slot.

Figure 10:
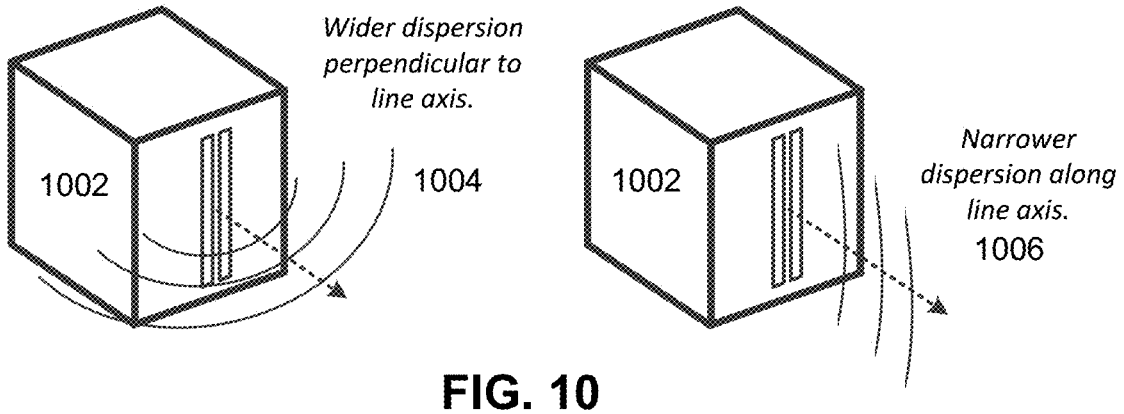
FIG. 10 shows the dispersion for a typical planar magnetic driver mounted in a simple loudspeaker cabinet 1002.

Other types of loudspeakers can also be adapted to this use. For example, many planar magnetic loudspeakers have long, narrow slits or exits, typically two. The long narrow exits, combined with the almost perfectly planar wave-front generate by planar magnetic driver diaphragm, results in a dispersion pattern that is even narrower in the axis of the line of the exit. FIG. 10 shows the dispersion for a typical planar magnetic driver mounted in a simple loudspeaker cabinet 1002. As shown in FIG. 10, the sound dispersion 1004 along an axis perpendicular to the slot axis is relatively wide, and wider than the sound dispersion 1006 along the slot axis. The two slots of a typical planar magnetic speaker 1002 are generally close enough that they act as a single slot.

Figure 11:
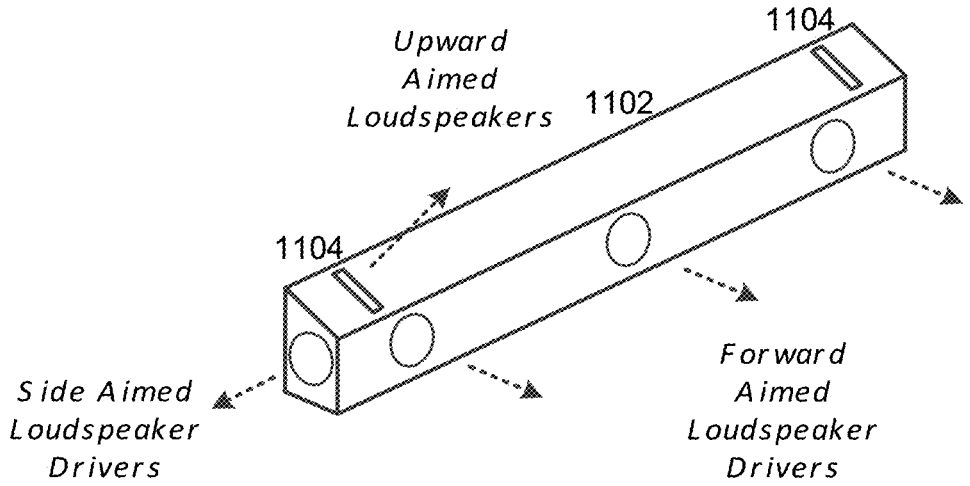
FIG. 11 shows an example soundbar that has slot exits for the upward firing drivers under some embodiments.

FIG. 11 shows an example soundbar, which has slot, exits for the upward firing drivers under some embodiments. As shown in FIG. 11, soundbar 1102 comprises an elongated speaker cabinet that includes one or more side-aimed loudspeaker and one or more forward aimed drivers, which can all be standard cone-type drivers. An angled top portion of the cabinet includes slot openings 1104 disposed proximately near either end of the cabinet. The drivers projecting sound through the slots 1104 can be cone or planar magnetic type drivers, or any other appropriate type of driver. As shown in FIG. 11, the top portion of soundbar is angled 1102 to project the upward aimed sound to be reflected off the ceiling at a particular angle. Alternatively, the top of the soundbar could be flat and with the slots 1104 placed in an angled recess.

As shown in FIG. 11, in general, the slotted drivers 1104 are oriented such that their height axes corresponds to or is parallel to the width and perpendicular to the length axis of the soundbar 1102, though other orientations are possible.

Figure 12A:
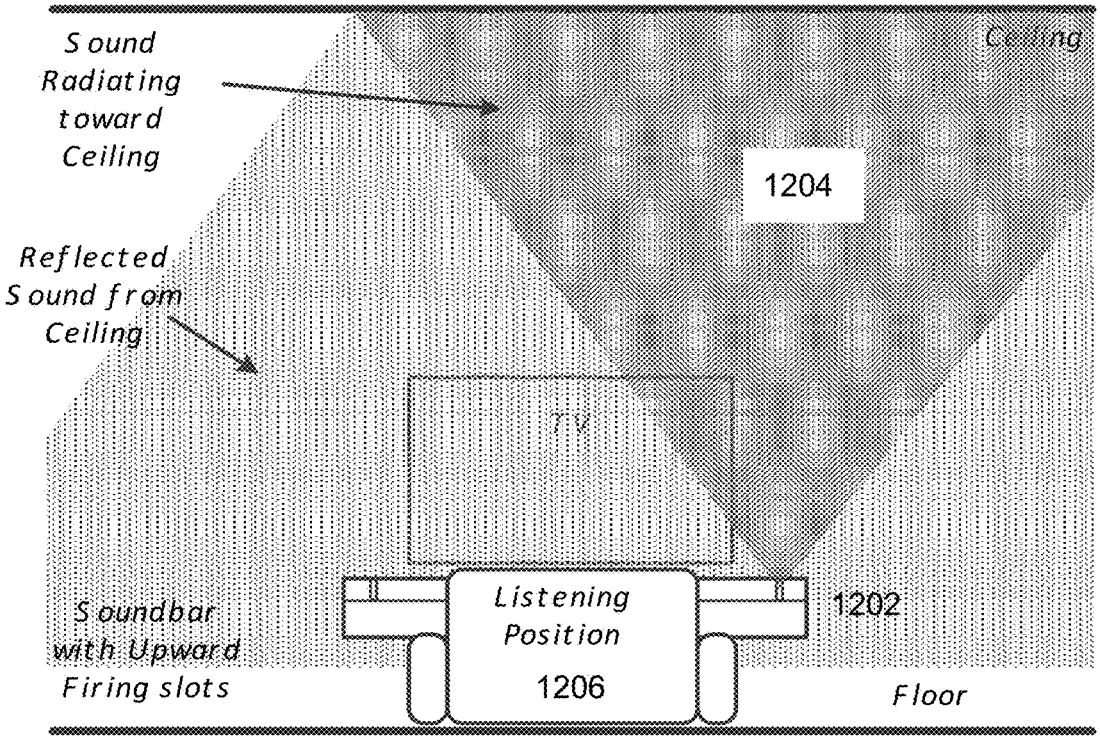
FIG. 12A illustrates a front view of right side high frequency sound dispersion for a soundbar with upward firing slots to reflect sound off a ceiling, under an example embodiment.

FIG. 12A illustrates a front view of right side high frequency sound dispersion for a soundbar with upward firing slots to reflect sound off a ceiling, under an example embodiment. As shown in FIG. 12A, soundbar 1202 reflects sound out of a right side slot driver up toward the ceiling to be reflected back down in a dispersion pattern 1204 to listening area 1202. An analogous dispersion pattern is also provided for the left side slot driver of soundbar 1202.

Figure 12B:
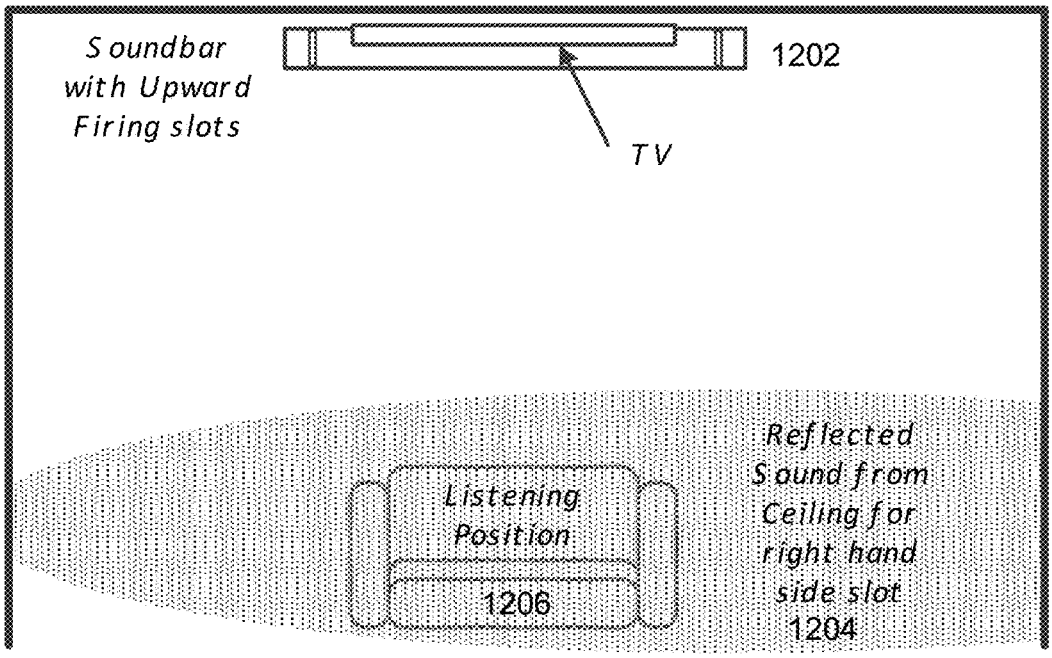
FIG. 12B illustrates a plan view of the right side high frequency sound dispersion for the soundbar of FIG. 12A under an example embodiment.

FIG. 12B illustrates a plan view of the right side high frequency sound dispersion for the soundbar of FIG. 12A under an example embodiment. As shown in FIG. 12B, the sound dispersion pattern 1204 of the reflected sound from the right side driver of soundbar 1202 covers the listening position 1206 in a fairly comprehensive manner with respect to the width of the position. Thus, for the high frequency sound dispersion for the right side soundbar slot, the wider horizontal dispersion of the slot provides a much wider listening area side-to-side across the room and better covers the listening position than in previous configurations described and illustrated above.

Figure 13A:
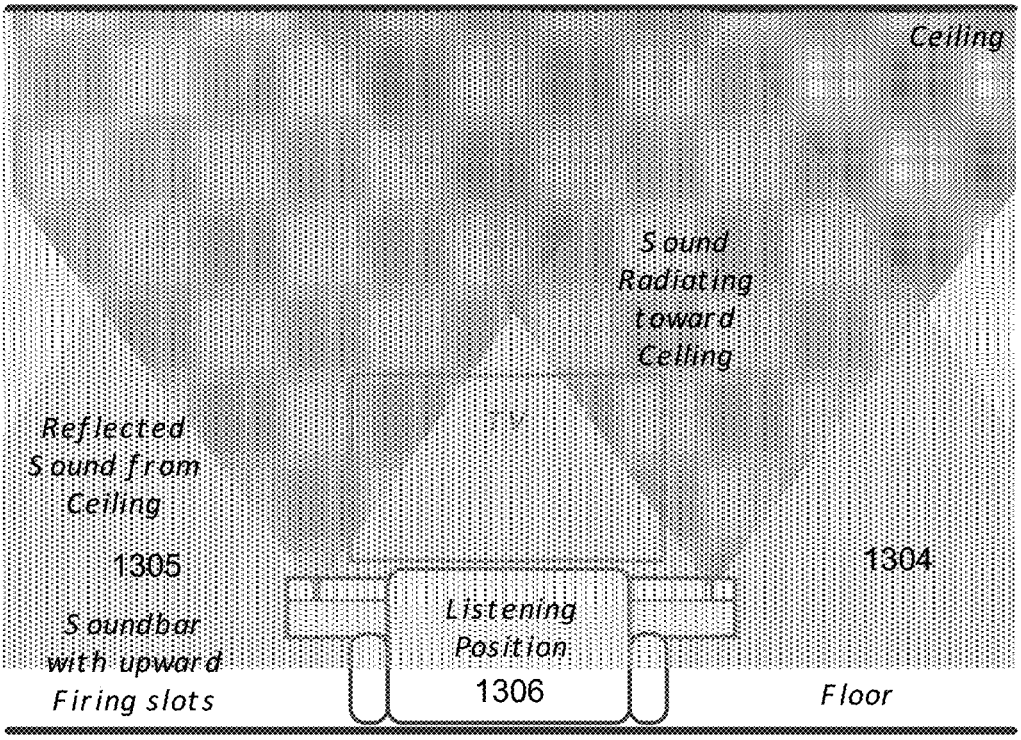
FIG. 13A illustrates a front view of left and right side high frequency sound dispersion for a soundbar with upward firing slots to reflect sound off a ceiling, under an example embodiment.
Figure 13B:
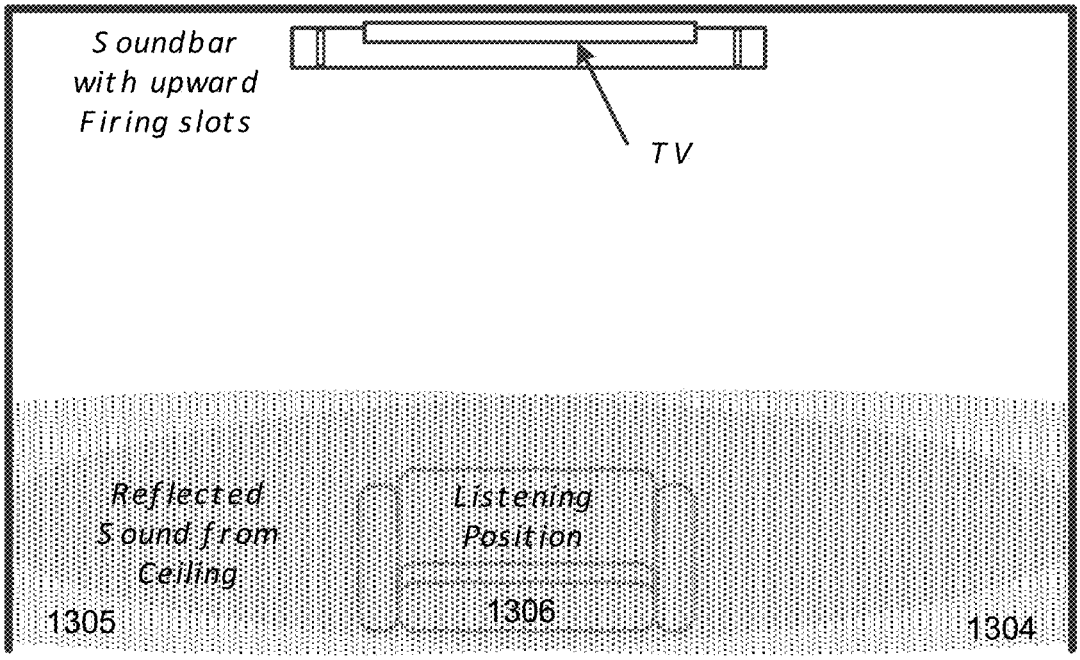
FIG. 13B illustrates a plan view of left and right side high frequency sound dispersion for the soundbar of FIG. 13A, under an example embodiment.

FIGS. 13A and 13B show the high frequency sound dispersion for both the left and right slots of soundbar, under some embodiments. FIG. 13A illustrates a front view of the left side high frequency sound dispersion 1305 and the right side high frequency sound dispersion 1306 for a soundbar with upward firing slots to reflect sound off a ceiling, under an example embodiment. FIG. 13B illustrates a plan view of left and right side high frequency sound dispersion for the soundbar of FIG. 13A, under an example embodiment. As can be seen in FIGS. 13A and 13B, the sound dispersion patterns 1304 and 1305 exhibit a large amount of overlap in the coverage of the two slots and any person seated in the listening position 1306 hears sound from both sides. As shown in FIG. 13B, the soundbar speaker projects reflected sound that provides wider horizontal or side-to-side dispersion to better cover the listening position 1306 as compared to previous speaker systems.

Figure 3A:
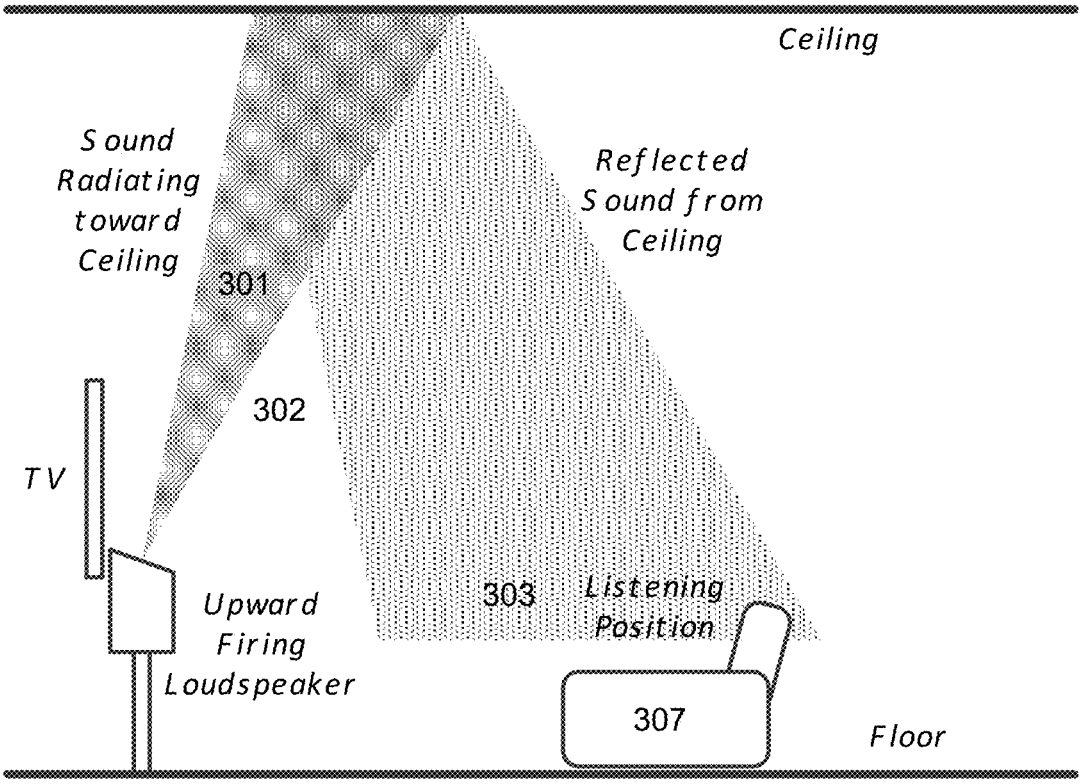
FIG. 3A (PRIOR ART)
FIG. 3A illustrates example high frequency sound dispersion for a typical known upward firing loudspeaker firing reflected sound off of a ceiling.
Figure 3B:
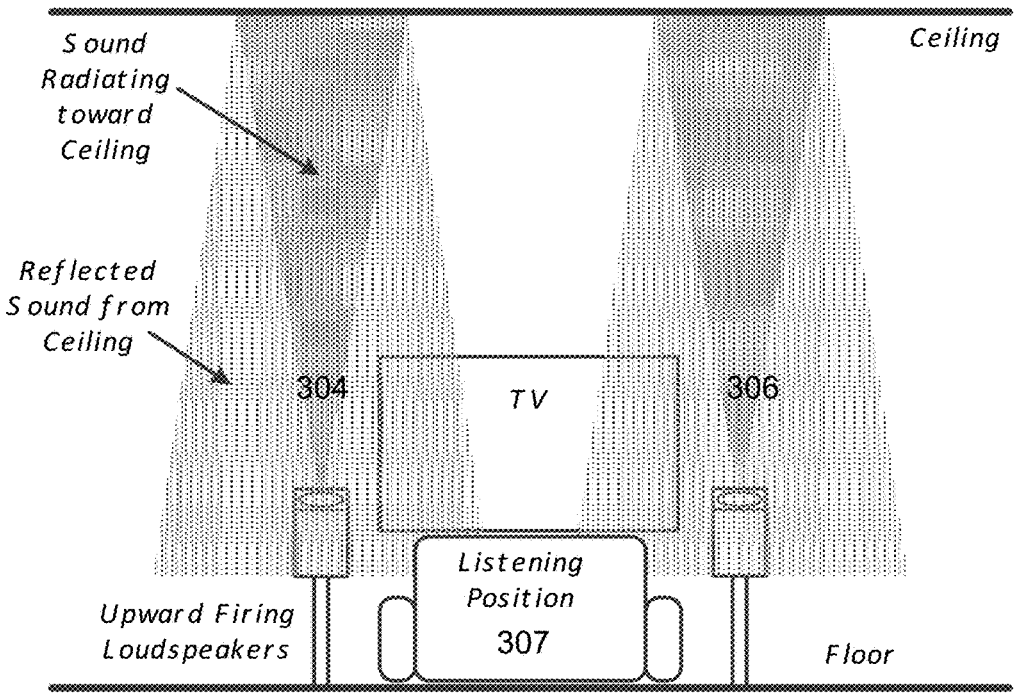
FIG. 3B (PRIOR ART)
FIG. 3B shows a front view of the sound dispersion for the speaker setup of FIG. 3A.
Figure 3C:
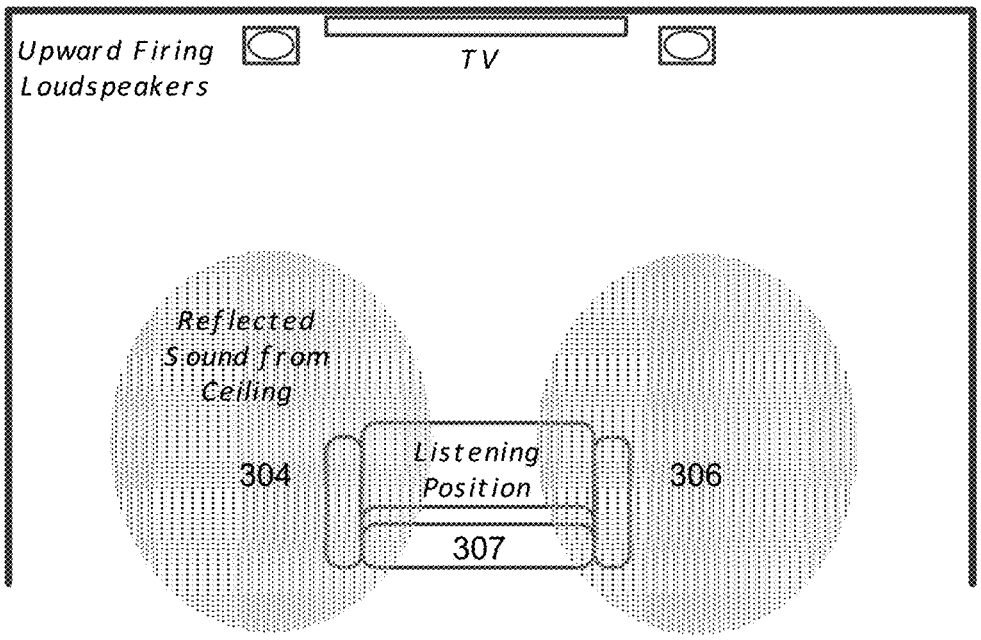
FIG. 3C (PRIOR ART)
FIG. 3C shows a top view of the sound dispersion patterns of FIG. 3B.
Figure 4B:
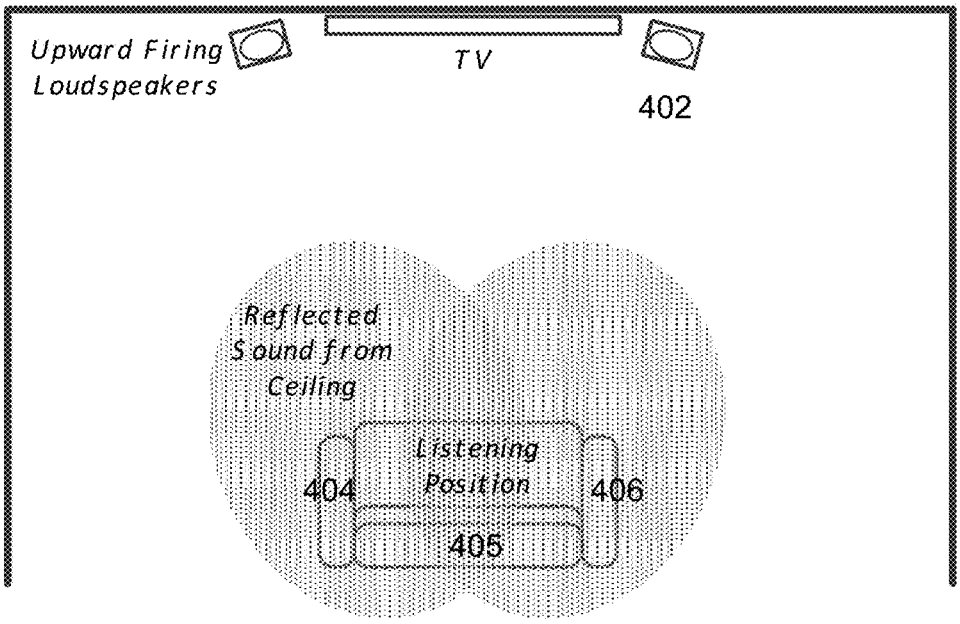
FIG. 4B (PRIOR ART)
FIG. 4B illustrates a top view of the sound dispersion patterns of FIG. 3B.

As stated above, the slots shown for the soundbar could be horn slot loaded drivers as shown in FIG. 7 or typical loudspeaker drivers covered by a baffle with a slot exit. Alternatively long, narrow exit planar-magnetic drivers could be used in place of the slots. The use of slots or narrow planar-magnetic drivers in this upward firing configuration eliminates the need for complicated mounting in the soundbar where the upward firing drivers need to be horizontally rotated or angled toward the listening position, as shown in FIG. 4B. Furthermore slots or narrow planar magnetic drivers could be used in the free standing speakers in or in recessed in-wall loudspeakers, as shown in FIGS. 3A to 3C such that they do not need to be angled toward the listening position.

In an embodiment, the upward-firing slotted drivers of FIG. 11 are full bandwidth drivers configured to playback an approximately full or nearly full audio spectrum (e.g., 100 Hz to 16 kHz). Alternatively, the slotted drivers 1104 can be configured to operate in certain frequency bands, such as bass, mid-range, and high frequency, and may thus be implemented as bass drivers, mid-range drivers, or tweeters. Such drivers may be used in conjunction with other drivers to provide the full bandwidth required by the reflected audio content. The dimensions and construction materials for the speaker cabinet 1102 may be tailored depending on system requirements, and many different configurations and sizes are possible. For example, in an embodiment, the cabinet may be made of medium-density fiberboard (MDF), or other material, such as wood, fiberglass, Perspex, and so on; and it may be made of any appropriate thickness, such as 0.75" (19.05 mm) for MDF cabinets.

Figure 14:
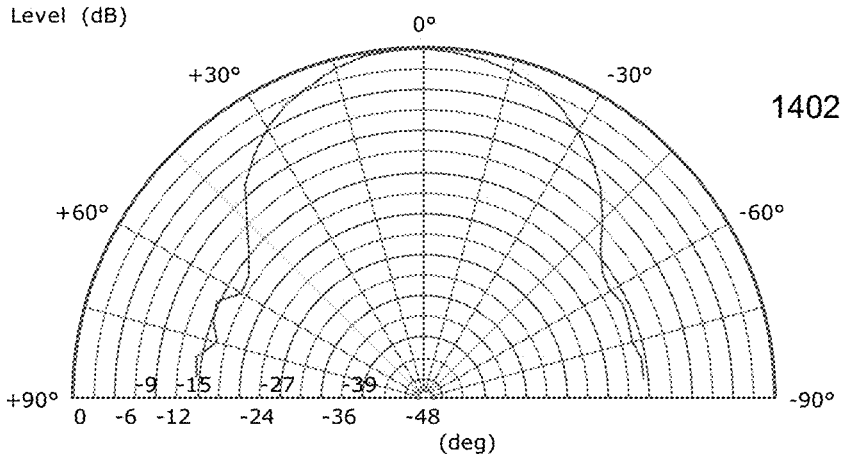
FIG. 14 shows the sound radiation or dispersion pattern of a small (approx. 3") diameter loudspeaker driver at a frequency of 7 kHz under an example embodiment.

With respect to upwardly projected sound for reflected sound playback, certain measurements yield relevant characteristics. For example, it has been found that sound frequencies around 7 kHz are generally key to the perception of height. Due various aspects of the human auditory system, sounds coming from above a listener have a higher proportion of sound energy around 7 kHz than sounds emanating from a similar height to the listeners ears and head. FIG. 14 shows the sound radiation or dispersion pattern of a small (approx. 3") diameter loudspeaker driver at a frequency of 7 kHz under an example embodiment. The upward direction (0 degrees) in the graph 1402 is the direction of aiming of the loudspeaker. Since the driver is circular, the pattern is the same around the axis or direction of aiming. The width of the main lobe can be calculated as the angle between the −10 dB sound levels, relative to the aiming direction. For graph 1402, the angle is approximately 80 degrees.

Figure 15A:
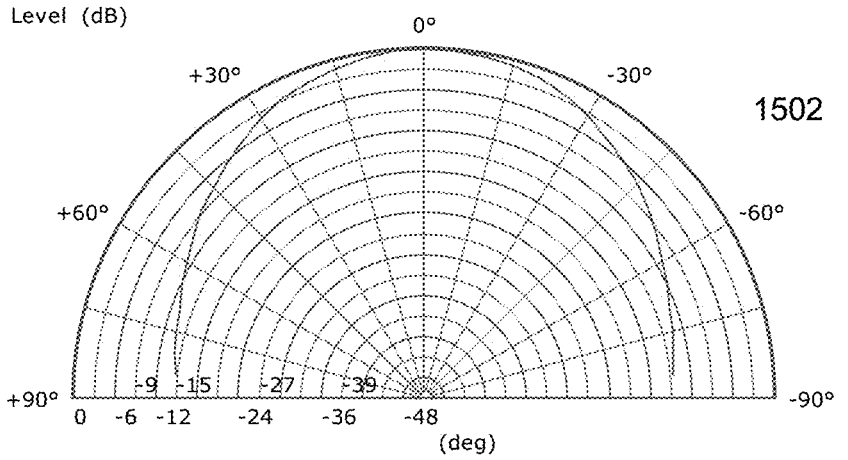
FIG. 15A illustrates an example horizontal radiation pattern at 7 kHz for a planar magnetic or ribbon driver of approximately 4 inches high, under an embodiment.
Figure 15B:
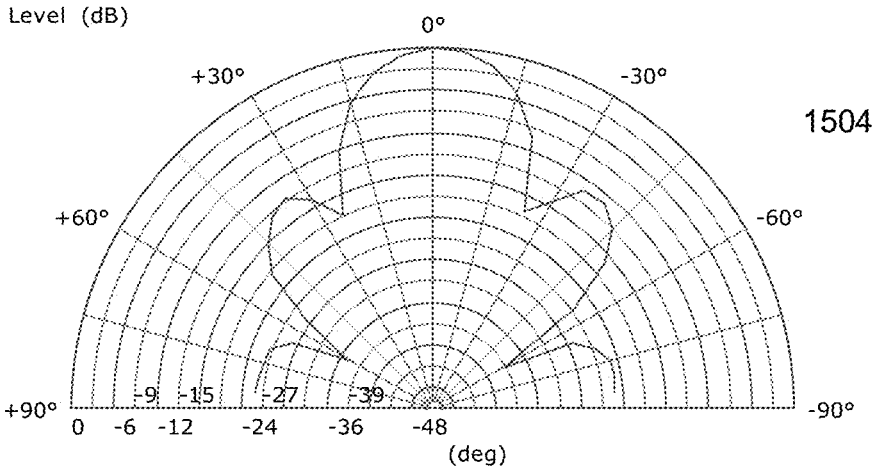
FIG. 15B illustrates an example vertical radiation pattern at 7 kHz for the planar magnetic or ribbon driver of FIG. 15A, under an embodiment.

As shown in FIG. 8, the sound dispersion of a slotted horn or ribbon driver is different depending on the direction of sound projection relative to the axis (horizontal or vertical) relative to the slot axis. FIG. 15A illustrates an example horizontal radiation pattern at 7 kHz for a planar magnetic or ribbon driver of approximately 4 inches high, under an embodiment; and FIG. 15B illustrates an example vertical radiation pattern at 7 kHz for the planar magnetic or ribbon driver of FIG. 15A, under an embodiment. As shown in FIGS. 15A and 15B, the main sound beam is horizontally wide and vertically narrow. For purposes of comparison between a cone driver and a slotted driver, the horizontal pattern width of FIG. 15A is approximately 110 degrees, which is wider than the 3" driver of FIG. 14; and the vertical pattern width of FIG. 15B is approximately 40 degrees, which is narrower than the 3" driver of FIG. 14.

Virtual Height Filter

In an embodiment, a spatial audio system utilizes upward-firing drivers to provide the height element for overhead audio objects, and may be played through a soundbar, such as illustrated in FIG. 11. In general, the height element is achieved partly through the perception of reflected sound from above the listener. In practice, however, sound does not radiate in a perfectly directional manner along the reflected path from the upward-firing driver. Some sound from the upward firing driver will travel along a path directly from the driver to the listener, diminishing the perception of sound from the reflected position. The amount of this undesired direct sound in comparison to the desired reflected sound is generally a function of the directivity pattern of the upward firing driver or drivers. To compensate for this undesired direct sound, it has been shown that incorporating signal processing to introduce perceptual height cues into the audio signal being fed to the upward-firing drivers improves the positioning and perceived quality of the virtual height signal. For example, a directional hearing model has been developed to create a virtual height filter, which when used to process audio being reproduced by an upward-firing driver, improves that perceived quality of the reproduction. In an embodiment, the virtual height filter is derived from both the physical speaker location (approximately level with the listener) and the reflected speaker location (above the listener) with respect to the listening position. For the physical speaker location, a first directional filter is determined based on a model of sound travelling directly from the speaker location to the ears of a listener at the listening position. Such a filter may be derived from a model of directional hearing such as a database of HRTF (head related transfer function) measurements or a parametric binaural hearing model, pinna model, or other similar transfer function model that utilizes cues that help perceive height. Although a model that takes into account pinna models is generally useful as it helps define how height is perceived, the filter function is not intended to isolate pinna effects, but rather to process a ratio of sound levels from one direction to another direction, and the pinna model is an example of one such model of a binaural hearing model that may be used, though others may be used as well.

An inverse of this filter is determined and used to remove the directional cues for audio travelling along a path directly from the physical speaker location to the listener. Next, for the reflected speaker location, a second directional filter is determined based on a model of sound travelling directly from the reflected speaker location to the ears of a listener at the same listening position using the same model of directional hearing. This filter is applied directly, essentially imparting the directional cues the ear would receive if the sound were emanating from the reflected speaker location above the listener. In practice, these filters may be combined in a way that allows for a single filter that both at least partially removes the directional cues from the physical speaker location, and at least partially inserts the directional cues from the reflected speaker location. Such a single filter provides a frequency response curve that is referred to herein as a "height filter transfer function," "virtual height filter response curve," "desired frequency transfer function," "height cue response curve," or similar words to describe a filter or filter response curve that filters direct sound components from height sound components in an audio playback system.

With regard to the filter model, if $P_1$ represents the frequency response in dB of the first filter modeling sound transmission from the physical speaker location and $P_2$ represents the frequency response in dB of the second filter modeling sound transmission from the reflected speaker position, then the total response of the virtual height filter $P_T$ in dB can be expressed as: $P_T=\alpha(P_2-P_1)$, where $\alpha$ is a scaling factor that controls the strength of the filter. With $\alpha=1$, the filter is applied maximally, and with $\alpha=0$, the filter does nothing (0 dB response). In practice, $\alpha$ is set somewhere between 0 and 1 (e.g. $\alpha=0.5$) based on the relative balance of reflected to direct sound. As the level of the direct sound increases in comparison to the reflected sound, so should $\alpha$ in order to more fully impart the directional cues of the reflected speaker position to this undesired direct sound path. However, $\alpha$ should not be made so large as to damage the perceived timbre of audio travelling along the reflected path, which already contains the proper directional cues. In practice a value of $\alpha=0.5$ has been found to work well with the directivity patterns of standard speaker drivers in an upward firing configuration. In general, the exact values of the filters $P_1$ and $P_2$ will be a function of the azimuth of the physical speaker location with respect to the listener and the elevation of the reflected speaker location. This elevation is in turn a function of the distance of the physical speaker location from the listener and the difference between the height of the ceiling and the height of the speaker (assuming the listener's head is at the same height of the speaker).

Figure 16:
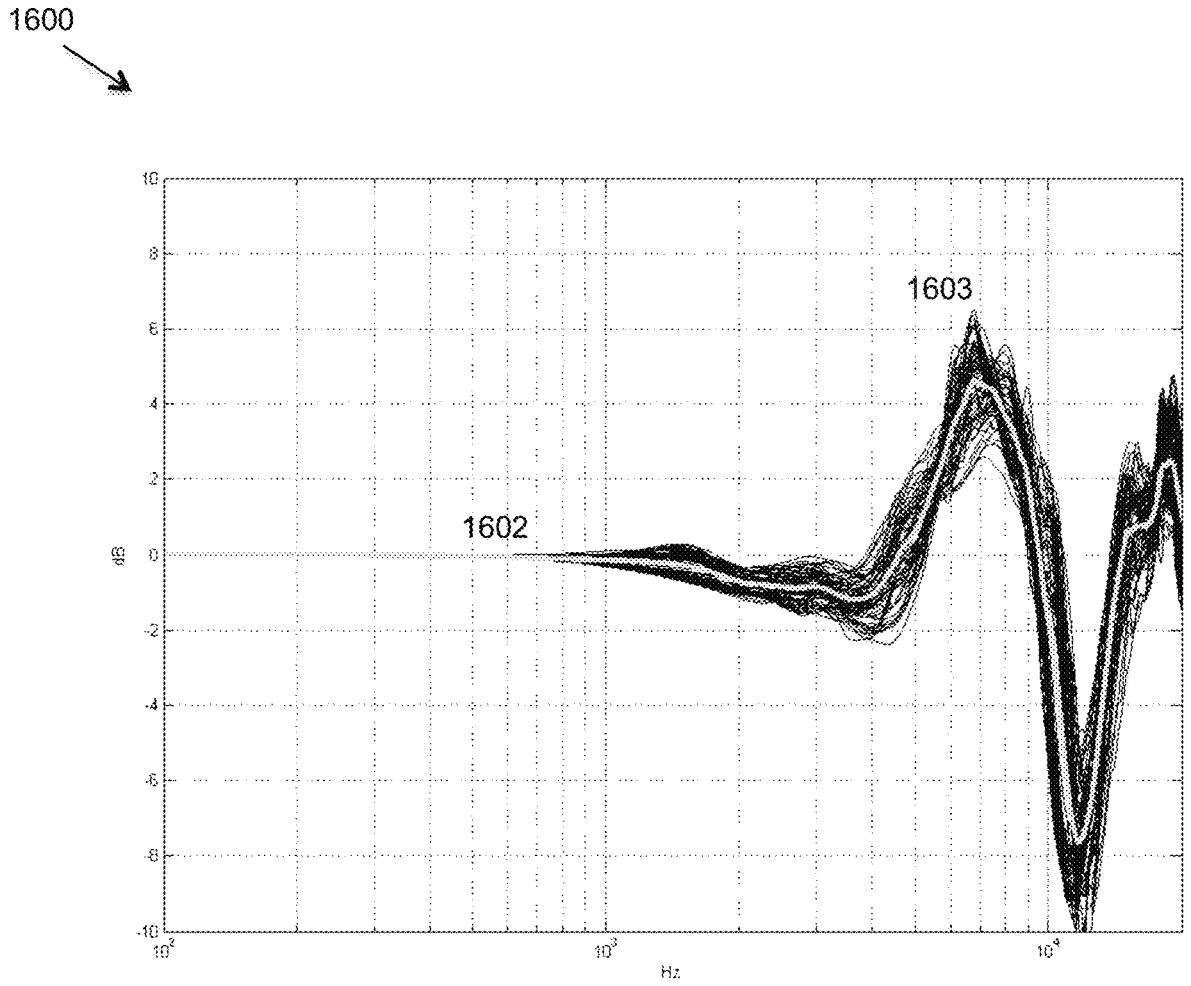
FIG. 16 depicts virtual height filter responses derived from a directional hearing model based on a database of HRTF (head related transfer function) responses averaged across a large set of subjects and that may be used for a virtual height filter under some embodiments.

FIG. 16 depicts virtual height filter responses $P_T$ with $\alpha=1$ derived from a directional hearing model based on a database of HRTF responses averaged across a large set of subjects. The black lines 1603 represent the filter $P_T$ computed over a range of azimuth angles and a range of elevation angles corresponding to reasonable speaker distances and ceiling heights. Looking at these various instances of $P_T$, one first notes that the majority of each filter's variation occurs at higher frequencies, above 4 Hz. In addition, each filter exhibits a peak located at roughly 7 kHz and a notch at roughly 12 kHz. The exact level of the peak and notch vary a few dB between the various responses curves. Given this close agreement in location of peak and notch between the set of responses, it has been found that a single average filter response 1602, given by the thick gray line, may serve as a universal height cue filter for most reasonable physical speaker locations and room dimensions. Given this finding, a single filter $P_T$ may be designed for a virtual height speaker, and no knowledge of the exact speaker location and room dimensions is required for reasonable performance. For increased performance, however, such knowledge may be utilized to dynamically set the filter $P_T$ to one of the particular black curves in graph 1600 of FIG. 16, corresponding to the specific speaker location and room dimensions.

The typical use of such a virtual height filter for virtual height rendering is for audio to be pre-processed by a filter exhibiting a particular magnitude response before it is played through the upward-firing virtual height speaker. The filter may be provided as part of the speaker unit, or it may be a separate component that is provided as part of the renderer, amplifier, or other intermediate audio processing component.

In an embodiment, a passive or active height cue filter is applied to create a target transfer function to optimize height reflected sound. The frequency response of the system, including the height cue filter, as measured with all included components, is measured at one meter on the reference axis using a sinusoidal log sweep and must have a maximum error of ±3 dB from 180 Hz to 5 kHz as compared to the target curve using a maximum smoothing of one-sixth octave. Additionally, there should be a peak at 7 kHz of no less than 1 dB and a minimum at 12 kHz of no more than −2 dB relative to the mean from 1,000 to 5,000 Hz. It may be advantageous to provide a monotonic relationship between these two points. For the upward-firing driver, the low-frequency response characteristics shall follow that of a second-order highpass filter with a target cut-off frequency of 180 Hz and a quality factor of 0.707. It is acceptable to have a rolloff with a corner lower than 180 Hz. The response should be greater than −13 dB at 90 Hz. Self-powered systems should be tested at a mean SPL in one-third octave bands from 1 to 5 kHz of 86 dB produced at one meter on the reference axis using a sinusoidal log sweep.

With regard to speaker directivity, in an embodiment, the upward-firing speaker system requires a relative frequency response of the upward-firing driver as measured on both the reference axis and the direct response axis. The direct-response transfer function is generally measured at one meter at an angle of +70° from the reference axis using a sinusoidal log sweep. The height cue filter is included in both measurements. There should be a ratio of reference axis response to direct response of at least 5 dB at 5 kHz and at least 10 dB at 10 kHz, and a monotonic relationship between these two points is recommended.

Additional and greater detail and configurations of a virtual height filter can be found in U.S. Patent Application 62/093,902 (D14054USP3), which is hereby incorporated by reference in its entirety.

In general, the upward-firing speakers incorporating virtual height filtering techniques as described herein can be used to reflect sound off of a hard ceiling surface to simulate the presence of overhead/height speakers positioned in the ceiling. A compelling attribute of the spatial audio content is that the spatially diverse audio is reproduced using an array of overhead speakers. As stated above, however, in many cases, installing overhead speakers is too expensive or impractical in a home environment. By simulating height speakers using normally positioned speakers in the horizontal plane, a compelling 3D experience can be created with easy to position speakers. In this case, the spatial audio system is using the upward-firing/height simulating drivers in a soundbar allows the spatial reproduction information of objects to create the audio being reproduced by the upward-firing drivers. The virtual height filtering components help reconcile or minimize the height cues that may be transmitted directly to the listener as compared to the reflected sound so that the perception of height is properly provided by the overhead reflected signals.

Aspects of the systems described herein may be implemented in an appropriate computer-based sound processing network environment for processing digital or digitized audio files. Portions of the audio system may include one or more networks that comprise any desired number of individual machines.

The soundbar speaker of FIG. 11 incorporating slotted drivers for the upward aimed drivers can be of any appropriate size, dimension and configuration depending on the audio system and listening environment characteristics. Some example configurations include a sound bar of between 8 to 16 inches in length with a pair of slotted speakers vertically oriented near the ends of the soundbar, as in soundbar 1102, and wherein the top surface of the soundbar cabinet is an inclined surface with an inclination angle of between 18 degrees to 22 degrees. The listening position can be located at a distance of about 4 to 12 feet from the soundbar depending on the height of the ceiling and the angle of inclination. The slotted driver can be a cone or ribbon (planar magnetic) driver projecting through a slotted baffle or a horn driver with an exit formed into a narrow slot. The slot can be a narrow rectangle having a height dimension approximately 4 to 8 times a width dimension of the rectangle, and a pair of narrow slots may be used to form each single slot. Other configurations and dimensions are also possible in keeping with the various embodiments described herein.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A speaker for transmitting sound waves to be reflected off an upper surface of a listening environment, comprising:

a cabinet containing a plurality of audio drivers;

one or more direct-firing drivers within the cabinet and oriented to transmit sound along a horizontal axis substantially perpendicular to a front surface of the cabinet;

a top surface of the cabinet arranged as an inclined surface having an inclination angle of between 18 to 22 degrees relative to the horizontal axis, the top surface having projection slots cut therethrough and located proximately close to outer ends of the inclined surface and oriented to be perpendicular to a length axis of the speaker;

an upward-firing cone driver placed proximate to the each outer end of the top surface of the cabinet and configured to transmit sound through a respective projection slot of the projection slots, wherein each respective projection slot has a slot dimension wherein a slot length is the same dimension as the diameter of the cone driver, and further wherein the slot dimension is configured to produce at high frequencies, a relatively wide sound dispersion pattern perpendicular to a slot axis, and a relatively narrow sound dispersion pattern along the slot axis, and further wherein a distance between the projection slots is configured to create an overlapping reflected sound projection for the high frequencies when reflected down to a listening position located at a distance in front of the speaker with wider horizontal dispersion corresponding to the length axis of the speaker.

2. The speaker of claim 1 wherein the cabinet comprises a unitary enclosure containing the plurality of audio drivers.

3. The speaker of claim 2 wherein the cabinet comprises an elongated cabinet having a shorter width axis relative to the length axis.

4. The speaker of claim 1 wherein the cabinet comprises two or more independent speaker cabinets, each containing at least one of the plurality of audio drivers.

5. The speaker of claim 4 wherein the cabinet comprises a pair of independent speaker cabinets, each containing at half of the plurality of audio drivers.

6. The speaker of claim 1 further comprising a pair of sideward firing speakers, each firing directly out of a side of the cabinet proximate a location below a respective projection slot and perpendicular to the front surface.

7. The speaker of claim 1 wherein the rectangular slot comprises a narrow rectangle having a height dimension approximately 4 to 8 times a width dimension of the rectangle.

8. The speaker of claim 7 wherein the narrow rectangle comprises two closely spaced narrow rectangles.

9. The speaker of claim 8 wherein the high frequencies comprise frequencies 7 kHz and above, and wherein the distance is in the range of 6 to 12 feet.

10. The speaker of claim 1, further comprising a virtual height filter circuit applying a frequency response curve to a signal transmitted to the slotted drivers to create a target transfer curve.

11. The speaker of claim 10, wherein the virtual height filter compensates for height cues present in sound waves transmitted directly through the listening environment in favor of height cues present in the sound reflected off the upper surface of the listening environment.

* * * * *